United States Patent [19]

Ghosh et al.

[11] 4,370,399

[45] Jan. 25, 1983

[54] EQUISENSITIVE AMBIPOLAR INDIUM DOPED SELENIUM CONTAINING ELECTROPHOTOGRAPHIC MATERIALS, PLATES AND METHOD

[75] Inventors: Syamal K. Ghosh, Elk Grove Village; Frank D. Kelly, Chicago, both of Ill.

[73] Assignee: A. B. Dick Company, Niles, Ill.

[21] Appl. No.: 246,605

[22] Filed: Mar. 23, 1981

[51] Int. Cl.[3] ..... G03G 5/04

[52] U.S. Cl. ..... 430/58; 430/95; 427/76

[58] Field of Search ..... 430/95, 58; 427/76

[56] References Cited

U.S. PATENT DOCUMENTS 3,685,989 8/1972 Galen ..... 430/95 X
3,712,810 1/1973 Ciuffini ..... 430/95 X

OTHER PUBLICATIONS

Chemical Abstracts 1972–1976, Index pp. 19699, 19703, 19700, 19712, Col. 106387k of vol. 83.
Solid State Abstracts (1976), p. MA–63, No. 218533s & 210289s.

*Primary Examiner*—John D. Welsh
*Attorney, Agent, or Firm*—McDougall, Hersh & Scott

[57] ABSTRACT

An ambipolar electrophotographic plate and materials used in the manufacture thereof including a photoconductive layer formulated of selenium, selenium-arsenic alloy or selenium-arsenic-tellurium alloy containing indium as a dopant which extends the range for electrons without noticeable deterioration of the long range for holes.

10 Claims, 3 Drawing Figures

EQUISENSITIVE AMBIPOLAR INDIUM DOPED SELENIUM CONTAINING ELECTROPHOTOGRAPHIC MATERIALS, PLATES AND METHOD

BACKGROUND OF THE INVENTION

This invention relates to an ambipolar electrophotographic plate and to the method for manufacture thereof.

In the art of xerography, a xerographic plate containing a photoconductive insulating layer is imaged by first uniformly electrostatically charging its surface. The plate is then exposed to a pattern of activating electromagnetic radiation such as light, which selectively dissipates the charge in the illuminated areas of the photoconductive insulator while leaving behind a latent electrostatic image in the non-illuminated areas. This latent electrostatic image may then be developed to form a visible image by depositing finely-divided electroscopic marking particles on the surface of the photoconductive insulating layer.

The use of vitreous or amorphous selenium remains the most widely used photoreceptor in commercial reusable xerography. A amorphous selenium is capable of holding and retaining an electrostatic charge for relatively long periods of time when not exposed to light, and is relatively sensitive to light as compared to most other photoconductive materials.

Amorphous selenium conducts both electrons and holes, but the mobility of the holes is approximately ten times greater than that for electrons. Thus, it can be stated that amorphous selenium while possessing a long range for holes has a very short range for electrons. The effect of this characteristic on the xerographic utility of selenium can best be understood by examining the basic process steps of xerography. As stated above, an amorphous selenium photoconductive layer is first sensitized by placing a uniform electrostatic charge on the surface of the photoconductive insulating material. This uniform charge creates a relatively strong field across the selenium (generally relative to a conductive backing). The amorphous selenium is then exposed to radiation to which it is sensitive, usually in the blue-green portion of the visible spectrum. The absorption of activating radiation acts to create hole-electron pairs in the selenium at the point of absorption of the impinging radiation. If the sensitizing charge on the surface of the selenium is negative, positive charge created by the radiation migrates to the surface to neutralize existing negative charges while the photogenerated negative charges are repelled by the remaining sensitizing charge to migrate through the selenium toward the conductive backing. When the sensitizing charge on the surface of the selenium is positive, the reverse is true. Electrons created by the radiation migrate to the surface to neutralize positive charges and the photogenerated holes or positive charge carriers are repelled to migrate through the selenium to the conductive backing. Inasmuch as selenium has a very short range for electrons, when used with negative charging, the result is that a large number of electrons are trapped in the bulk of the selenium layer, thereby rendering the plate unfit for further use in xerography until the trapped charges are freed. In that selenium has a long range for holes, when used with positive sensitizing charges, trapping is reduced to a sufficiently small degree so as not to interfere with the utility of the material for xerographic processes. It therefore has become the usual practice in xerography, when using amorphous selenium, to employ positive polarity sensitizing charges at its surface.

There are many applications in electrophotography where it is desirable that amorphous selenium or other photoconductive layers have long range for both electrons and holes so that they can be used for both positive and negative charging characteristics, as for use in obtaining a reversal of the image, as in reversal microfilm printing and in laser printers.

As for example, it is desirable that amorphous selenium based photoreceptors have long range for both polarities of charge carriers when they are used in obtaining a reversal of the image to be reproduced in the normal xerographic process. In this case, if the normal xerographic plate is charged negatively and then the steps of the xerographic process are carried through, including development with carriers and toners as described for the normal xerographic process, there is obtained a negative or reversed image of the copy being reproduced. Thus, if the plate has a long range for both polarities of charge carriers it is possible merely by altering the polarity of the sensitizing charge to obtain either a positive or reversal reproduction of the subject matter being reproduced.

U.S. Pat. No. 3,077,386 to Blakney et al. describes one technique for treating selenium whereby the material acquires the property of having a long range for both polarities of charge carriers. This technique involves doping the selenium with a small amount of metal such as chromium, nickel, iron, zinc, calcium, titanium, or other similar material.

Another technique is described in U.S. Pat. No. 3,685,989 wherein use is made of amorphous selenium or an arsenic alloy of selenium which contains a small amount of sodium, lithium, potassium, rubidium, cesium or mixtures of the above wherein such alloying elements are present in an amount within the range of 5–5000 parts per million by weight.

Another technique is described in U.S. Pat. No. 3,712,810 wherein use is made of a thin layer of thallium doped amorphous selenium or thallium doped selenium-arsenic contained on the substrate, and a layer of amorphous selenium or selenium-arsenic overlaying the thallium doped layer.

OBJECTS OF THE INVENTION

It is an object of this invention to produce and to provide a method for producing an ambipolar electrophotographic plate which displays almost equal spectral sensitivity in the positive or negative mode, which is characterized by excellent thermal stability, high charge acceptance and minimum light fatique.

Another object of this invention is to provide an electrophotographic plate having a photoconductive layer formulated of selenium or an arsenic alloy of selenium in which the photoconductive layer is characterized by (1) ambipolar characteristics, (2) high charge acceptance when corona charged with either negative or positive polarity. (3) low dark decay at either polarity, (4) low residual potential at either polarity, (5) high rate of photo-induced discharge at either polarity, (6) low light fatigue at either polarity whereby the electro-optical parameters remain virtually unaltered after repeated cycles of charging and exposure to light, and (7) substantially equal spectral sensitivity at either polarity.

BRIEF SUMMARY OF THE INVENTION

The described objectives are achieved, in accordance with the practice of this invention, by the use of amorphous selenium or an arsenic alloy of selenium which has been doped with a small amount of indium. The doped selenium or arsenic alloy of selenium can be employed as a single photoconductive layer on a suitable conductive substrate such as aluminum or it can be employed in a separate thin layer underlying a relative thick bulk layer of amorphous selenium or arsenic alloy of selenium as an intermediate layer between the bulk layer of selenium and the conductive substrate.

BRIEF DESCRIPTION OF THE DRAWINGS

These and other objects and advantages of this invention will hereinafter appear, and for purposes of illustration, but not of limitation, the invention will be described with reference to the following drawings in which.

DETAILED DESCRIPTION OF THE INVENTION

As used hereinafter and in the claims, the term selenium is meant to refer to amorphous selenium, selenium alloyed with arsenic in the amounts of 0.01–2.0 and preferably 0.05–1.0 percent by weight arsenic, and said amorphous selenium and arsenic-selenium alloy doped with not more than 20 percent and preferably up to 10 percent by weight tellurium.

Figure 1:
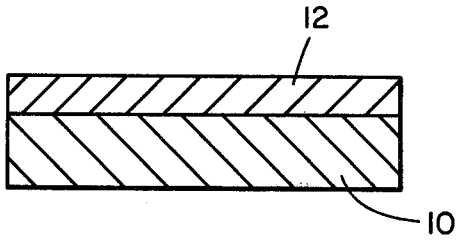
FIG. 1 is a sectional elevational view of an ambipolar electrophotographic plate embodying the features of this invention.
Figure 2:
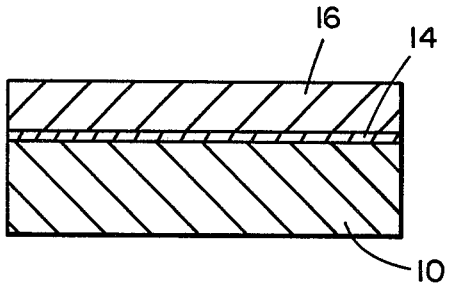
FIG. 2 is a sectional elevational view of another ramification of an ambipolar electrophotographic plate embodying the features of this invention.

It has been found, in accordance with the practice of this invention, that the range for electrons can be extended without affecting the intrinsic long range for holes when the selenium is doped with a small amount of indium. An ambipolar as well as a bi-sensitive electrophotographic plate embodying the features of this invention comprises a suitable conductive substrate 10 overlaid with a single layer 12 of indium doped selenium, as illustrated in FIG. 1 of the drawings or overlaid with a thin layer 14 of indium doped selenium provided with an overcoat of a relatively thick bulk layer 16 of selenium, as illustrated in FIG. 2 of the drawings. Doping selenium with a very small amount of indium operates to increase the spectral sensitivity of the photoconductor in the negative charging mode, without undesirably affecting the spectral sensitivity in the positive charging mode. In the two layer system, the interfacial layer of doped selenium functions in the manner of a charge generating member, while the top layer of selenium functions as a charge transport layer.

As the conductive substrate 10, use can be made of conductive materials generally employed in the fabrication of electrophotographic plates, although it is preferred to make use of aluminum or other conductive metals.

The desired ambipolar-bi-sensitive characteristics are exhibited when the indium dopant in the selenium layer is present in an amount within the range of 10–500 parts per million and preferably 70–100 parts per million in the layer. Chlorine can be added in small amounts up to 50 parts per million with the indium with improvement in hole mobility.

The following is a tabulation of elements and compositions illustrative of the practice of the invention:

| Elements | Composition Broad | Composition Narrow | Thickness Broad | Thickness Narrow |
|---|---|---|---|---|
| Photoreceptor layer 12 | 10–500 ppm indium<br>0.05–1.0% arsenic<br>0–50 ppm chlorine<br>Balance selenium | 70–100 ppm indium<br>0.1–0.5% arsenic<br>Balance selenium | 30–100μ | 60μ |
| Conductive support 10 | Aluminum<br>Steel<br>Brass<br>Aluminized mylar | | 1 mil- 0.05 inch<br>¼inch | |
| Charge transport layer 16 | 99.999% selenium<br>0.05–1.0% arsenic<br>0–50 ppm chlorine | 0.2–0.5% arsenic<br>10–30 ppm chlorine<br>Balance selenium | 30–100μ | 55–60μ |
| Charge generating layer 14 | 10–500 ppm indium<br>0.05–1.0% arsenic<br>0–50 ppm chlorine<br>0–20% tellurium<br>Balance selenium | 70–100 ppm indium<br>0.1–0.5% arsenic<br>0–10% tellurium<br>Balance selenium | 0.1–5μ | 1.0μ |

The invention will be illustrated by the following examples which are given by way of illustration and not by way of limitation.

EXAMPLE 1

Preparation of single layered ambipolar electrophotographic plate of the type illustrated in FIG. 1 of the drawings:

Composition:

85 ppm indium 0.3% arsenic

Balance selenium (amorphous)

The indium was of 99.999% purity from Alfa-Ventron. The arsenic was made available as a selenium-arsenic alloy containing 0.5–0.1 percent by weight arsenic, available from Canadian Copper Refineries Ltd. The selenium was of 99.999% purity supplied also from Canadian Copper Refineries Ltd.

Procedure:

The alloys were prepared by sealing the weighed amounts of material into a pyrex or quartz ampoule. The sealed ampoule was rocked inside an electric furnace at temperatures between 500°–600° C. for 6–8 hours. The elements were thorougly mixed while in a molten state and then allowed to air cool slowly to a temperature of about 250° C. The ampoule was then quenched in water after which the solid alloy was removed and ground to a finely divided form.

In preparation of the electrophotographic plate, the alloy was placed in tantalum or stainless steel boats and heated under a vacuum of $10^{-5}$–$10^{-7}$ torr. for vacuum deposition onto an aluminum substrate at a temperature between 55°–65° C. until a layer 12 having a thickness of about 60μ was deposited on the surface of the aluminum substrate 10.

EXAMPLE 2

Preparation of two layered system illustrated in FIG. 2 of the drawings:

| Compositions: |
|---|
| Charge transport layer 16 |
| (a) Selenium-arsenic alloy containing 0.3% by weight arsenic Balance 99.999% by weight selenium |
| (b) 99.999% by weight selenium |
| Charge generating layer 14 |
| (c) 70–100 ppm indium 5–10% by weight tellurium Balance selenium arsenic alloy containing 0.5–1.0% by weight arsenic |
| (d) 70–100 ppm indium Balance selenium-arsenic alloy containing 0.1–0.5% arsenic |

Procedure:

The alloys were prepared as in example 1.

The alloy (c) or (d) for the charge generating layer 14 was vacuum evaporated from tantalum boats under a vacuum of $10^{-5}$–$10^{-7}$ torr. for vapor deposition onto an aluminum plate at a temperature of 55°–65° C. until a layer 14 having a thickness of 1μ was deposited onto the aluminum substrate 10. Compositions (a) or (b) were vacuum deposited under the same conditions until a layer 16 of 55–60μ was deposited onto the charge generating layer 14.

In the foregoing examples the boat temperature was maintained within the range of 250°–300° C. during vacuum deposition. The rate of deposition was held at 1–2μ per minute.

For best results, it is desirable to maintain the temperature of the substrate within the range of 55°–60° C. When substrate temperature exceeds 60° C., the positive charging characteristics of the plate tend to dominate over negative charging while the opposite tendency occurs below 55° C., while satisfactory results can be obtained by vacuum deposition onto substrates at a temperature within the range of 50°–70° C.

Ambipolar electrophotographic plates prepared in accordance with examples 1 and 2 were compared with single layered electrophotographic plates in which the photoconductive layer was the same as in example 1 but without indium dopant, with the following results:

| Indium doped single layer photoreceptor (example 1) | | | | |
|---|---|---|---|---|
| Charging | Initial Charge Acceptance (volts) | Dark decay (volts/sec) | Residual potential | Light fatigue |
| Positive | 800–1000 | 1–20 | 10–80 | low |
| Negative | 800–1000 | 1–20 | 10–200 | low |
| Control Plate (selenium-arsenic-chloride) | | | | |
| Positive | 800–1000 | 1–20 | 0–80 | low |
| Negative | 100–300 | 10–100 | 10–200 | high |
| Two layered plate: indium doped interfacial layer (example 2 (a) (d) | | | | |

-continued

| Indium doped single layer photoreceptor (example 1) | | | | |
|---|---|---|---|---|
| Charging | Initial Charge Acceptance (volts) | Dark decay (volts/sec) | Residual potential | Light fatigue |
| Positive | 800–1000 | 1–20 | 0–100 | low |
| Negative | 800–1000 | 1–20 | 10–200 | low |
| Two layered plate (indium doped tellurium-selenium-arsenic interfacial layer) (example 2 (a) (c) | | | | |
| Positive | 800–1000 | 1–20 | 0–100 | low |
| Negative | 600–800 | 5–100 | 50–250 | high |

Figure 3:
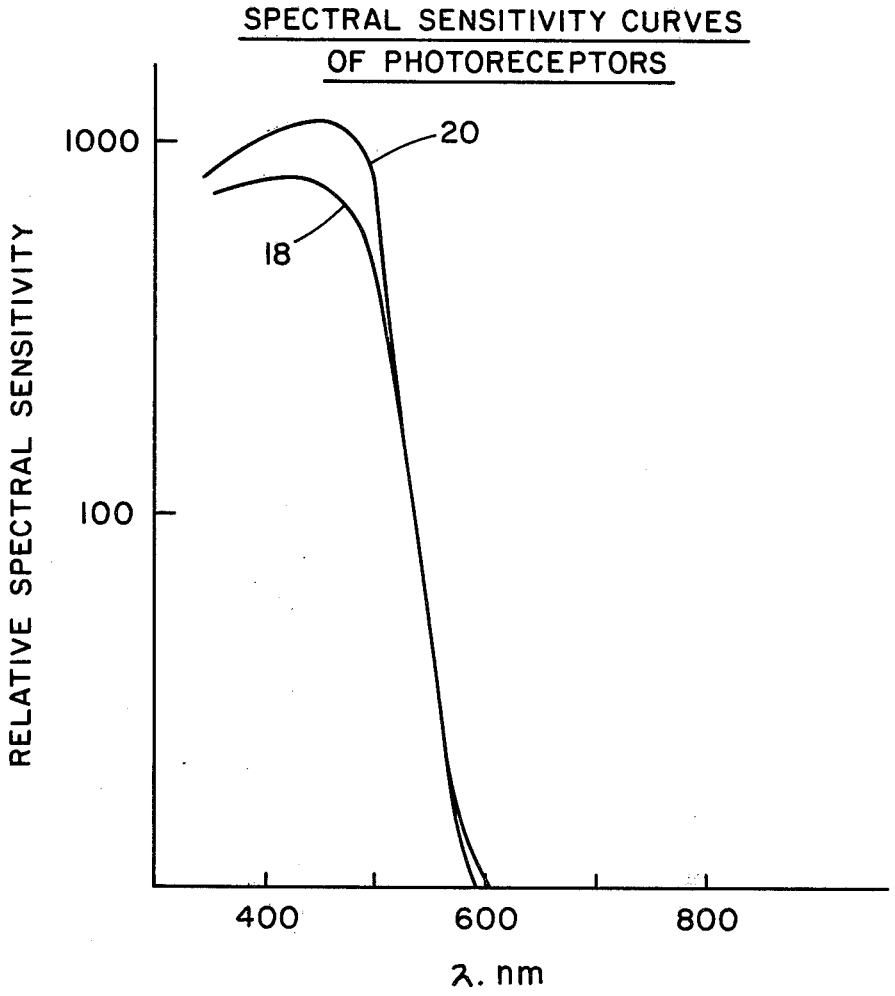
FIG. 3 are spectral sensitivity curves of photoreceptor embodying the features of this invention.

Plates of examples 1 and 2 were tested for spectral sensitivity, the results of which are illustrated by the curves in FIG. 3. For this purpose, the photoreceptor was corona charged to 800 volts of initial potential, either in positive or negative charging mode to obtain the respective spectral sensitivity curve. The photoreceptor was then irradiated with monochromatic radiation, as obtained from a 350 watt xenon lamp source using either band-pass filters or a monochromator from 400 nanometer through 800 nanometer. The photoreceptor was allowed to photo discharge to half its original potential for a given energy of radiation. The difference in potential for a given amount of light energy was plotted against the respective wavelength.

| Spectral Sensitivity Curves - Indium doped amorphous selenium-arsenic photoreceptor (example 1) | | |
|---|---|---|
| Curve 18 | Negative charging | Single layer |
| Curve 20 | Positive charging | Single layer |

Ordinate: Relative Spectral Sensitivity, volt/microjoule/(centimeter)$^2$
Abscissa: Radiation wavelength, nanometer Similar relationship was obtained with two layered indium doped amorphous selenium-arsenic photosensitive layers as represented by examples 2(a)(d) or 2(b)(d). Also, similar experiments were done with tellurium sensitized indium doped amorphous selenium-arsenic or selenium photosensitive layers as represented by examples 2(a)(c) or 2(b)(c). Very similar relationship is obtained. Spectral broadening in both charging modes occur which primarily depends on the proportion of tellurium content. When the tellurium content exceeds 10% by weight, the electro-optical characteristics at negative charging start to deteriorate, e.g. charge acceptance decreases, dark decay increases as does the residual potential.

It will be apparent from the foregoing that we have provided a photoconductive material characterized by high charge acceptance capable of corona charge with either positive or negative polarity, low dark decay, low residual potential at either positive or negative polarity, high rate of photo induced discharge, retention of electro-optical parameters after repeated cycles of charging and discharging and substantially equal spectral sensitivity at either positive or negative polarity. Materials of the type described are adapted for use in the preparation of equisensitive ambipolar electrophotographic plates when provided as a layer on substrates of conductive material.

It will be understood that changes may be made in the details of composition and manufacture without departing from the spirit of the invention, especially as defined in the following claims.

We claim:

1. An ambipolar electrophotograhic plate comprising a conductive substrate and a photoconductive layer on the substrate in which the photoconductive layer comprises selenium doped with indium in an amount within the range of 10–500 ppm.

2. An ambipolar electrophotographic plate as claimed in claim 1 in which the indium is present in an amount within the range of 70–100 ppm.

3. An ambipolar electrophotographic plate as claimed in claim 1 in which the photoconductive layer consists essentially of 0–50 ppm chlorine, 0–20 percent by weight tellurium, 10–500 ppm indium, with the remainder amorphous selenium or selenium alloyed with 0.01–2.0 percent by weight arsenic.

4. An ambipolar electrophotographic plate as claimed in claim 1 in which the photoconductive layer consists essentially of 0–50 ppm chlorine, 0–10 percent by weight tellurium, 70–100 ppm indium, with the remainder amorphous selenium or selenium arsenic alloy containing 0.05–1 percent by weight arsenic.

5. An ambipolar electrophotographic plate comprising a conductive substrate, a charge generating layer overlying the conductive substrate and a charge transport layer overlying the charge generating layer, in which the charge generating layer comprises selenium doped with indium in an amount within the range of 10–500 ppm.

6. An ambipolar electrophotographic plate as claimed in claim 5 in which the indium is present as a dopant in an amount within the range of 70–100 ppm.

7. An ambipolar electrophotographic plate as claimed in claim 5 in which the selenium is an amorphous selenium or selenium-arsenic alloy containing 0–50 ppm chlorine and 0–20 percent by weight tellurium and in which the arsenic is present as an alloying element in an amount within the range of 0.01–2.0 percent by weight.

8. An ambipolar electrophotographic plate as claimed in claim 7 in which the tellurium is present in an amount within the range of 0–10 percent by weight and the arsenic, when present as an alloying element, is present in an amount within the range of 0.05–1 percent by weight.

9. An ambipolar electrophotographic plate as claimed in claim 5 in which the charge transport layer is a relatively thick bulk layer of amorphous selenium.

10. An ambipolar electrophotographic plate as claimed in claim 1 which exhibits almost equal spectral sensitivity in both charging modes.

* * * * *